United States Patent [19]

Gamm

[11] Patent Number: 4,644,673

[45] Date of Patent: Feb. 24, 1987

[54] REARWARDLY OPENING POCKETED ATHLETIC SHOE

[75] Inventor: Robert J. Gamm, St. Louis, Mo.

[73] Assignee: Kangaroos U.S.A. Inc., Chesterfield, Mo.

[21] Appl. No.: 792,212

[22] Filed: Oct. 28, 1985

Related U.S. Application Data

[63] Continuation-in-part of Ser. No. 757,917, Jul. 22, 1985, Pat. No. 4,612,714, which is a continuation of Ser. No. 433,460, Oct. 8, 1982, abandoned, which is a continuation-in-part of Ser. No. 612,992, May 21, 1984, which is a continuation of Ser. No. 314,134, Oct. 23, 1981, abandoned.

[51] Int. Cl.[4] ..... A43B 23/00; A43B 5/00

[52] U.S. Cl. ..... 36/136; 36/114; 36/45

[58] Field of Search ..... 36/136, 132, 1, 114, 36/45; 2/DIG. 6

[56] References Cited

U.S. PATENT DOCUMENTS

| | | | |
|---|---|---|---|
| 2,801,477 | 8/1957 | Adams et al. | 36/136 |
| 4,255,876 | 3/1981 | Johnson | 36/45 X |
| 4,280,287 | 7/1981 | Gulbransen | 36/136 |
| 4,372,060 | 2/1983 | Adamik | 36/54 |
| 4,413,431 | 11/1983 | Cavanagh | 36/114 |
| 4,516,337 | 5/1985 | Adanik | 36/136 |

FOREIGN PATENT DOCUMENTS

| | | | |
|---|---|---|---|
| 1447044 | 6/1966 | France | 36/136 |
| 1347424 | 2/1974 | United Kingdom | 36/136 |

*Primary Examiner*—James Kee Chi

*Attorney, Agent, or Firm*—Paul M. Denk

[57] ABSTRACT

In an athletic, casual, or other form of footwear, constructed having a vamp, sole, quarter, and counter portions, all fabricated into the shoe structure, and incorporating a shoe tongue therewith, the quarter portion(s) for the footwear is fabricated of a pair of liners, the normal inner liner forming the standard quarter portion structure, with an overlying outer liner disposed thereon, arranging in an intermediate spacing therein, and which may function as a pocket for the deposition of personal items, such as keys, coins, or the like therein. Closure means, such as hook and pile fastening members may be provided proximate the rearward edges of the two fabricated liners, forming the shoe quarter portion, to assure a closure for the pocket when required, and the eyestay fabricated into the shoe quarter portion structure may extend angularly downwardly, in order to add reinforcement for the pocket structure particularly at that location where it is repeatedly pulled open, as when items may be arranged within the pocket structure, or removed therefrom. The shoe gusset or tongue may likewise be fabricated of a pair of liners, forming a pocket therein, so as to add a supplementary pocket to the footwear structure for securement of various items therein, as during shoe usage.

5 Claims, 7 Drawing Figures

REARWARDLY OPENING POCKETED ATHLETIC SHOE

CROSS-REFERENCE TO RELATED APPLICATION

The subject matter of this application is related to, in part, and comprises a continuation-in-part, of the application of the same inventor having Ser. No. 757,917, filed on July 22, 1985, now U.S. Pat. No. 4,612,714 and which application is denominated as a continuation of the application of the same inventor having Ser. No. 433,460, filed on Oct. 8, 1982, and now abandoned; and this application may also comprise a continuation-in-part of the application having Ser. No. 612,992, filed on May 21, 1984, and which application is denominated as a continuation of the application having Ser. No. 314,134, filed on Oct. 23, 1981, and now abandoned; all of the foregoing applications being owned by a common assignee.

BACKGROUND OF THE INVENTION

This invention pertains to athletic shoes, and more particularly is concerned with the formation of various pockets integrally within the structure of the athletic shoe, such as being fabricated within the shoes quarter portions, or within the tongue or gusset formed intermediate the upper edges of the shoe structure. Generally, the structure of this invention may also be embodied with the footwear of other types, such as casual shoes.

Applicant has obtained a variety of earlier patents pertaining to the formation of pocket structures within various components forming differing types of footwear, whether it be of the casual shoe type, but primarily relating to the field of athletic footwear. Such patents can be readily seen, and their structure determined, from reviewing the earlier U.S. Pat. Nos. 4,296,559, to Robert J. Gamm. Des. 261,823, Des. 261,695, and Des. 271,157. In addition, the U.S. Pat. No. 4,384,414 has issued to the same inventor, as has U.S. Pat. No. Des. 277,427. Applicant has a variety of additional United States and foreign patents and patent applications issued and pending upon his various footwear structures, most of them incoporating a fabricated pocket within some structural component forming the footwear, and more specifically the athletic shoe.

It is, therefore, the principal object of this invention to provide a rearwardly opening pocket that is fabricated into the structure of the quarter portion for an athletic or other shoe, and which opening is generally arranged facing directly rearwardly along the back edge of the normally structured quarter portion for the athletic shoe so as to be reasonably concealed from view while providing a shoe which presents a quarter portion that appears to be routinely structured into the fabricated shoe under normal manufacturing conditions.

Another object of this invention is to provide the foregoing type of pocket structure fabricated into the quarter portion for an athletic or other shoe, and which pocket structure may be integrally formed into both the right and left side quarter portions for the assembled shoe.

Another object of this invention is to provide means for reinforcing the pocket edges fabricated into the quarter portion for an athletic shoe, through the agency of integrally extending the eyestay portion for the footwear angularly downwardly towards the sole shank and in adjacency with the back or opening edge for the fabricated pocket as arranged along the rearwardly disposed edge of the footwear quarter portion.

Another object of this invention is to provide an athletic shoe, having a pocket structure fabricated therein, within at least one of its quarter portions, and wherein both the angularly extended eyestay in conjunction with the outer liner for the fabricated pocket both turn under at the sole shank for integration into the assembled shoe.

Another object of this invention is to provide slot means formed within the fabricated pocket for an athletic shoe, and more specifically within its pocket reinforcement for displaying various indicia in the nature of trademarks, owners name, or any other related information.

Still another object of this invention is to provide a footwear incorporating a pocket within the tongue or gusset portion for a formed athletic shoe.

These and other objects will become more apparent to those skilled in the art upon reviewing the summary of this invention, and upon undertaking a study of the description of its preferred embodiment, in view of the drawings.

SUMMARY OF THE INVENTION

This invention contemplates the formation of an athletic shoe, or other footwear, even that of the casual variety, and wherein the quarter portions forming the footwear structure are fabricated of a pair of liners, the inner liner forming the basic shoe structure, that lies in adjacency with any foot inserted within the shoe during its usage, while the outer liner is fabricated to the appearance of the standard quarter portion forming the footwear structure. These pair of liners extend rearwardly, and proximate or at the formed back edge for the quarter portion for the shoe, the liners may be separate and pulled apart for providing access into the pocket formed within the spacing disposed intermediately the two pair of adjacent liners. In addition, the eyestay portion for the footwear that normally reinforces the upper edge of the quarter portion, where the shoe lacing routinely ties, may extend further integrally downwardly, or perhaps comprise a separate piece of strap material, so as to furnish and afford additional reinforcement for this back edge of the formed quarter portion for the shoe, to assure that structural stability is provided for the formed pocket, particularly where its opening edges are repeatedly pulled apart, when attaining access into or for the removal of items from within the formed pocket, as during usage.

In addition to the foregoing, these rearward edges of the liners forming the quarter portion for the athletic shoe, and more specifically providing for the structured pocket therein, may normally be urged and held into closure, through the application of a closure means intermediate these adjacent rear edge surfaces for the formed pocket. Such closure means may comprise a zipper means, but preferably will be fabricated from strips of Velcro which are adhered to each liner, at this location, and which when pressed together, provide for a secure closing of the pocket structure during usage. In addition, that portion of the eyestay, or its reinforcing strap, extending downwardly along this aft edge of the quarter portion may have a slot formed therein, for the application of identifying indicia therein, such as a trademark, a name, or any other information desired for insertion therein.

In addition to the foregoing, this pocket structure for the athletic shoe may be fabricated in one of the quarter portions forming the shoe structure, or it may be located within each quarter portion provided to either side of the formed footwear. Furthermore, an additional pocket structure may be provided by the inclusion of a pocket within the tongue or gusset portion for the athletic shoe, so as to actually furnish three pockets, at the most, within the shoe structure, during its fabrication, and for the convenience of the footwear user.

DESCRIPTION OF THE PREFERRED EMBODIMENT

Figure 1:
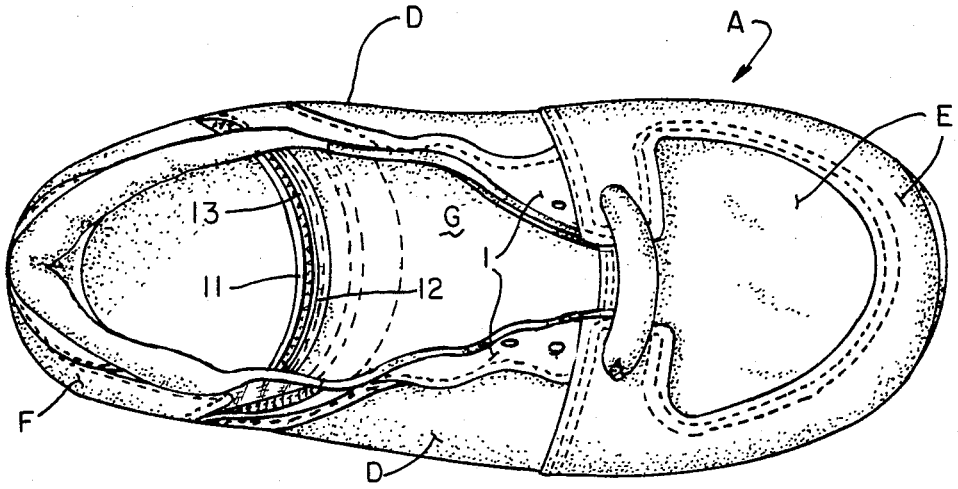
FIG. 1 is a top view of the rearwardly opening pocketed athletic shoe of this invention.
Figure 2:
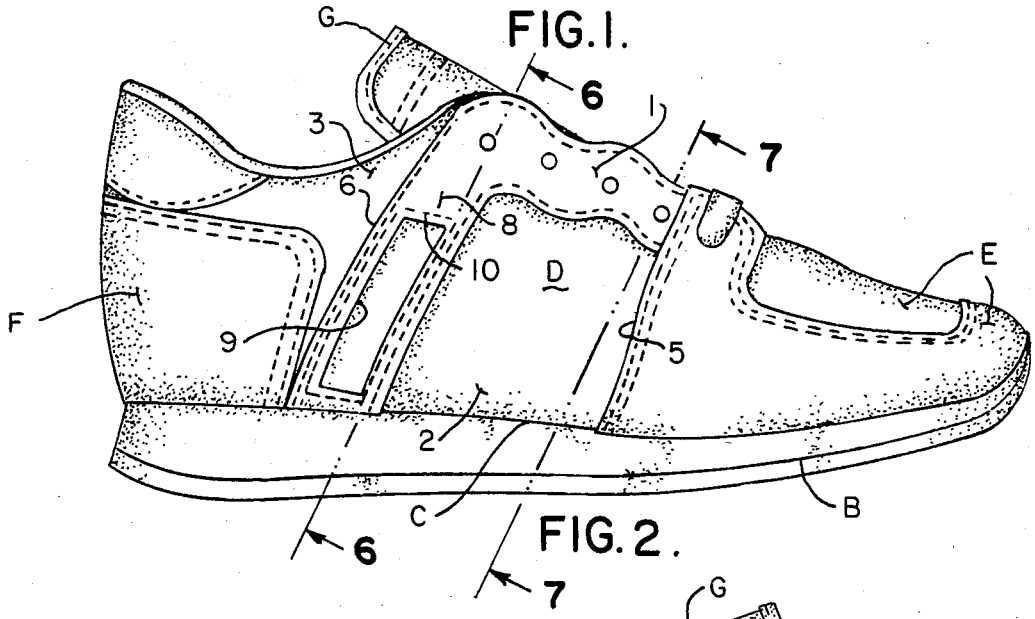
FIG. 2 is a right side view thereof.
Figure 3:
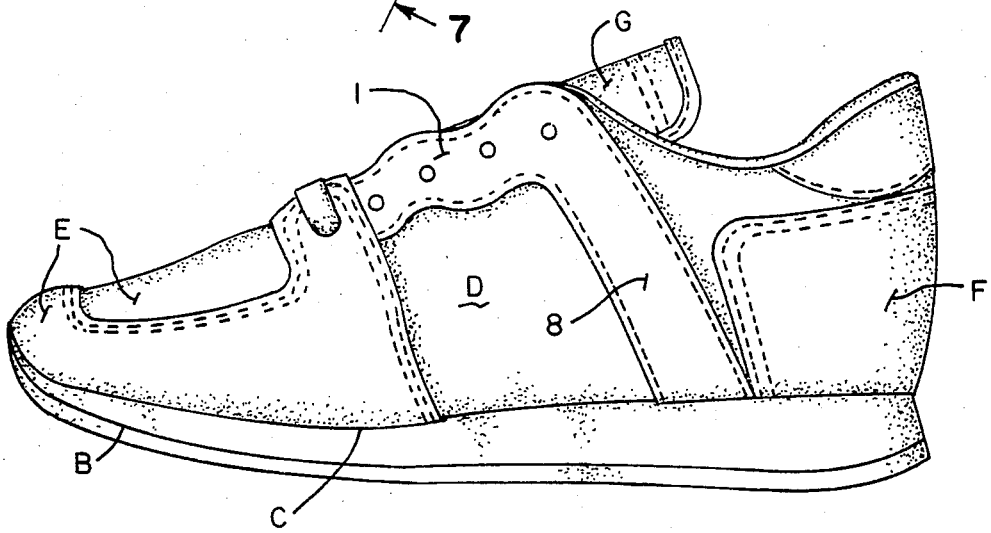
FIG. 3 is a left side view thereof.

In referring to the drawings, and in particular FIGS. 1 through 3, there is shown both the top, and various side views for an athletic shoe A, which is fabricated of the usual construction having a sole portion B stitched, glued, or otherwise adhered at its shank C to the shoe quarter D, in addition to the upper and lower vamp portions E, and its counter F, forming the shoe upper as normally constructed into an assembled footwear. In addition, an eyestay 1 is also stitched to the shoe quarter portions, at their upper margins, as can be seen, and are useful for securing the usual lacing that hold the shoe in place upon the foot of its wearer. Furthermore, the usual tongue or gusset G is likewise provided generally secured with and extending upwardly and rearwardly from the footwear upper vamp part E.

Figure 4:
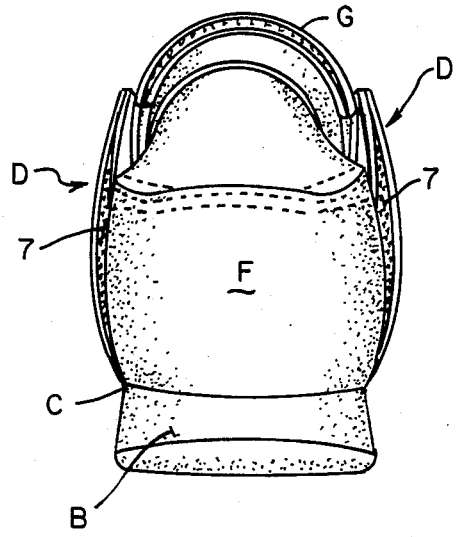
FIG. 4 is a rear view thereof.
Figure 5:
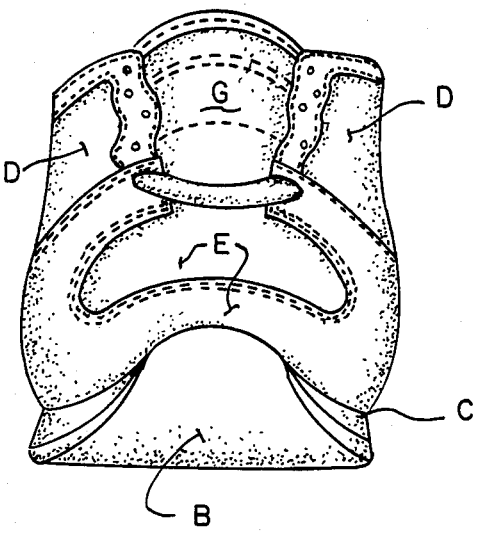
FIG. 5 is a front view thereof.
Figure 6:
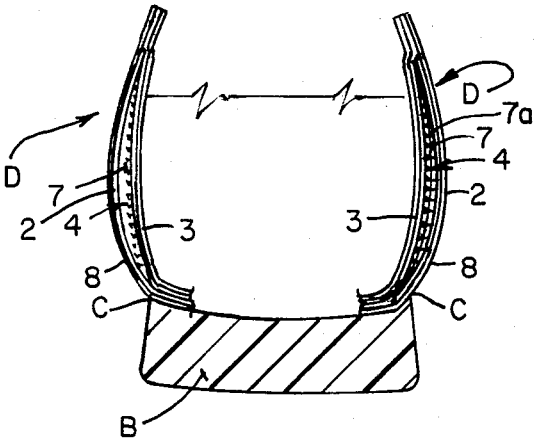
FIG. 6 is a sectional view of a pocket structure, proximate its entrance, taken along the line 6—6 of FIG. 2.
Figure 7:
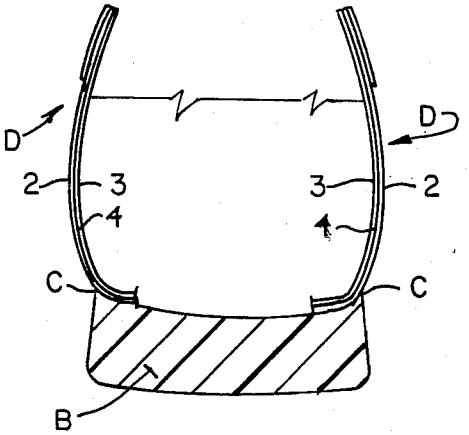
FIG. 7 is a sectional view of a pocket structure at a more forwardly location taken along the line 7—7 of FIG. 2.

In the specific construction of this particular invention, and as can also be seen in FIGS. 4 through 7, the quarter portions D are fabricated from a pair of liners, as at 2 and 3, the inner liner 3 comprising the standard quarter portion for the fabricated footwear, while the outer liner 2 is assembled as an extra layer for the quarter portion and which extends downwardly and rearwardly with this fabricated portion for the shoe, and generally may extend thereunder, or be turned under, as at the sole shank C, for securement with the upper layer of the shoe sole B, generally below any inner sole that may be located therein. On the other hand, it is just as likely that the outer layer or liner 2 forming the quarter portion for this footwear may end, at its lower edge, upwardly from the sole shank C, and thereby form more of a patch type pocket that is integrated into the structure of the quarter portion for the shown athletic or other footwear. Regardless, the concept of this invention is the formation of the quarter portions for the athletic shoe of at least a pair of liners, and through the adjacency of these two liners fabricated into the shoe structure, the spacing provided intermediate thereof, as at 4, provides a sufficient opening over the entire area for the dimensioned quarter portion for the shoe to form a pocket structure therein. And, as can be seen in FIGS. 4 and 6, such pockets may be fabricated into both the left and right side quarter portions formed of the athletic shoe, to provide a pair of pockets thereat, or such a pocket structure may be fabricated only to one side of the shoe, and form a pocket within just one of the quarter portions for the constructed shoe.

In reviewing FIG. 2, once again, it can generally be seen that the pocket structure that is built into the fabricated shoe, at its quarter portion D, may extend to an approximate front edge, as at 5, where it is stitched into the shoe structure along the back edge of the disclosed lower vamp portion for the shoe. In addition, the pocket as formed may extend all the way up to and be furnished underlying the eyestay 1 for the shoe, while at its lower extent, as previously explained, the outer liner 2, in association with the inner liner 3 for the quarter portion, may be turned at the sole shank C, so as to furnish pocket spacing all the way down to this location for the fabricated shoe. Furthermore, the outer liner 2 may extend sufficiently rearwardly, to its rear edge 6, and thereby, as can be seen, present a pocket structure that extends substantially over the underlying surface of the formed quarter portion 3 for the structured shoe.

As can be also seen in FIGS. 4 and 6, proximate the back edges of the formed liners 2 and 3, there may be provided closure means, as at 7, and in this particular instance, may comprise a strip of Velcro, which is a form of hook and pile connector, with one segment of the Velcro being connected to the rear disposed surface of the liner 3, while the cooperating segment of the Velcro will be secured to the inner rear edge surface for the formed pocket liner 2. This Velcro will be of sufficient width, perhaps a quarter to a half inch or so, in order to provide for complete and secure closure for the formed pocket, or perhaps both pockets, structured into the quarter portions for the athletic shoes.

In addition to the foregoing, and in order to afford sufficient reinforcement for the structured shoe, and more specifically its fabricated pocket, and to assure its structural integrity and resistance to damage or tearing as through repeated usage and openings, as can be seen in FIGS. 2, 3, and 6, the eyestay 1 may extend integrally downwardly as at 8, and therein furnish sufficient reinforcement at least to the rear edge of the outer liner 2, so as to assure its integrity, even after repeated usage, as previously explained. In the alternative, it is just as likely that this eyestay 1, or more particularly its segment 8, may be a separate band from that of the eyestay 1, but yet extend angularly downwardly in the fashion as shown, to not only add to the esthetics of the footwear at this location, but likewise to furnish that additional strength, as explained.

Furthermore, and as can be seen, this extended eyestay portion, or strip 8, may contain a slot therein, as at 9, and wherein various identifying indicia may be located, such as a banner for displaying a trademark, the owner's name, or any other identifying information, as desired. Once located, as for example the trademark label, it may be stitched in place through the use of stitching 10, or secured in any other manner, in order to afford protection against loss. In addition, it is just as likely that the upper edge of this slot 9, as at the location of the stitching 10, may contain an additional slot, so other forms of identifying indicia may be inserted therein.

In addition to the foregoing, it is likely that further pocket structure may be located within the fabricated shoe. As can be seen in FIGS. 1 and 4, the gusset or tongue portion G may likewise be formed of a pair of liners, as at 11 and 12, one comprising the inner liner 11, the other comprising the outer linner 12, and have a spacing arranged intermediately thereof, and extend for some distance down the gusset towards the vamp E, in order to form a pocket structure therein, also. Such liners 11 and 12 may be stitched along their side edges, with their upper edges, as disclosed, having a closure means, such as Velcro, to assure closure for the pocket structure once secured. It is just as likely that these closure means as previously explained for the various pocket structures, such as the closure means 7, for the quarter portion pockets, or the closure means as at 13, fabricated into the shoe gusset, may be formed of Velcro, as previously explained, or may comprise any other form of securing means, such as a zipper 7*a*, or the like. These are just examples of the types of closure means that may be employed.

Variations or modifications to the structure of this invention may occur to those skilled in the art upon reviewing the subject matter of this disclosure. Such variations or modifications, if within the spirit of this invention, are intended to be encompassed within the scope of any claims to patent protection issuing herein. The description of the preferred embodiment set forth is primarily explained for illustrative purposes only.

Having thus described the invention, what is claimed and desired to be secured by Letters Patent is:

1. In a pocket for an athletic shoe designed to hold smaller sized personal items such as keys, coins, or the like, comprising, said shoe having a quarter portion secured approximate the sole shank at its lower extent, said quarter portion being formed of a pair of liners, said liners comprising an inner and outer liner, and forming a pocket therebetween, extending from the shoe eyestay to its sole shank, the outer liner having a rear edge, said outer liner at its rear edge being normally free of connection with the inner liner of the quarter portion, fastening means provided intermediate the inner and outer liners extending approximately along the rear edge of the formed quarter portion, said inner and outer liners forming the quarter portion at their rear edges being capable of being pulled apart to provide access into the formed pocket arranged intermediately thereof to provide for deposition or removal of the aforesaid type of items therefrom, an eyestay provided along the upper quarter portion for the formed shoe, said eyestay at its rearwardmost location integrally extending downwardly for securement to the athletic shoe proximate its shoe shank, said downwardly extending eyestay providing for reinforcement for the formed pocket and its pair of liners proximate the rear edge of the formed pocket.

2. The invention of claim 1 and wherein said closure means comprising a hook and pile connector.

3. The invention of claim 1 and wherein said closure means comprising a zipper.

4. The invention of claim 1 and wherein there being said pocket formed within each quarter portion provided to either side of said athletic shoe.

5. The invention of claim 4 and wherein each downwardly extending eyestay turning under with the shoe quarter portion at the sole shank.

* * * * *